United States Patent [19]

Payne

[11] 4,119,301

[45] Oct. 10, 1978

[54] ROLLAWAY FENCE

[75] Inventor: Dannie L. Payne, Medina, N.Y.

[73] Assignee: The Raymond Lee Organization, Inc., New York, N.Y. ; a part interest

[21] Appl. No.: 781,190

[22] Filed: Mar. 25, 1977

[51] Int. Cl.[2] ..... E04H 17/02

[52] U.S. Cl. ..... 256/41; 273/29 BD

[58] Field of Search ..... 256/37, 40, 41, 42, 256/43, 44; 273/29 BC, 29 BD, 29 BF, 29 BG, 29 BB

[56] References Cited

U.S. PATENT DOCUMENTS

| | | | |
|---|---|---|---|
| 84,919 | 12/1868 | Valentine et al. | 256/42 |
| 172,460 | 1/1876 | Lightfoot | 256/41 |
| 417,993 | 12/1889 | Doud | 256/41 |
| 534,234 | 2/1895 | Stowell et al. | 256/40 |
| 1,250,631 | 12/1917 | Novess | 256/41 |
| 1,287,319 | 12/1918 | Howard | 256/41 |
| 3,508,741 | 4/1970 | Steenhoudt | 256/40 |

FOREIGN PATENT DOCUMENTS

| | | | |
|---|---|---|---|
| 3,858 | 10/1932 | Australia | 256/41 |

*Primary Examiner*—Andrew V. Kundrat
*Attorney, Agent, or Firm*—Daniel Jay Tick

[57] ABSTRACT

A plurality of rolls of flexible fence cable are wound on a shaft in a drum. The free ends of the cables outside the drum are affixed to a cross bar in spaced parallel relation with each other. The fence cables are unwound through side holes formed in the drum and via a guide member in the drum and are extended via the cross bar to the next-adjacent fence post.

2 Claims, 8 Drawing Figures

FIG. 2

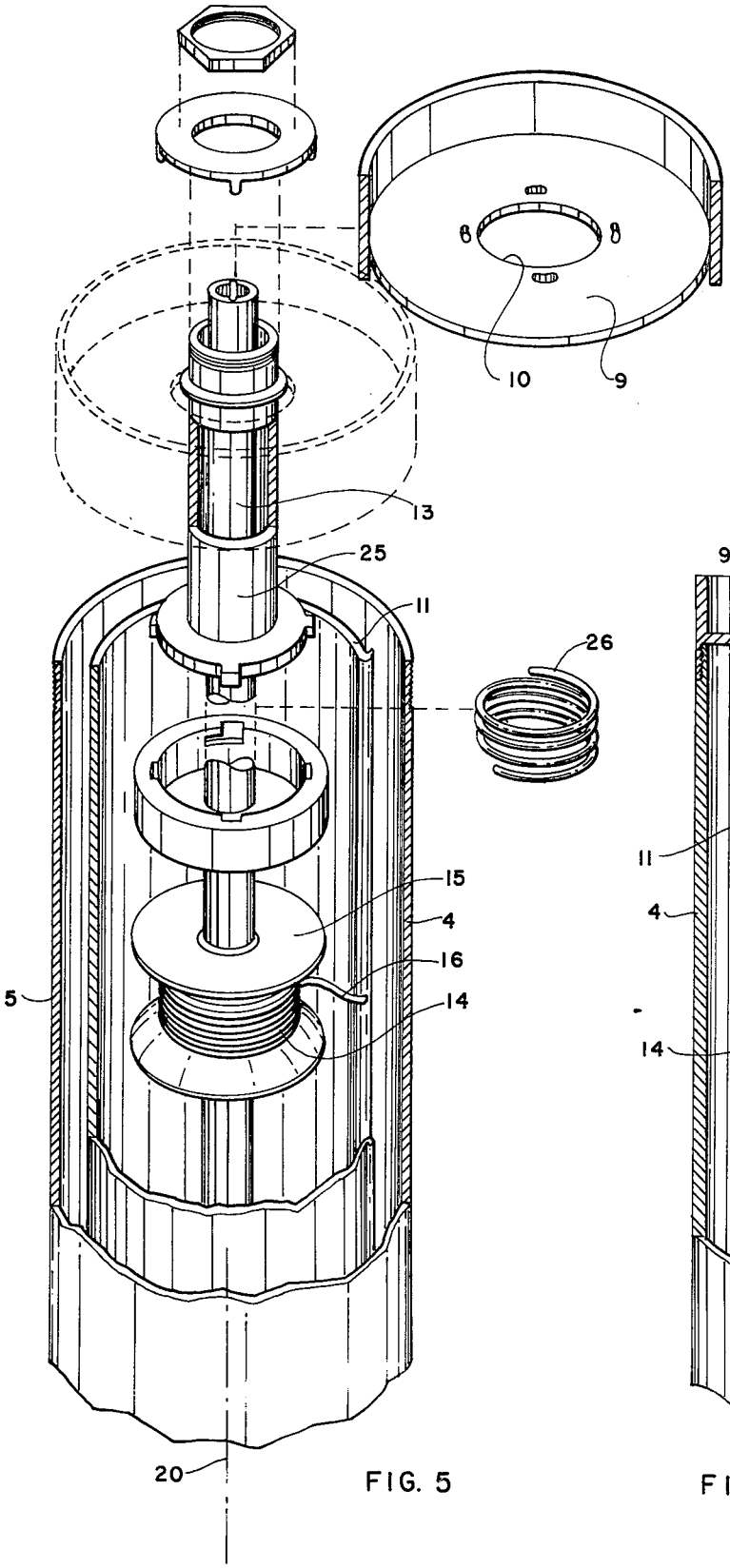
FIG. 5
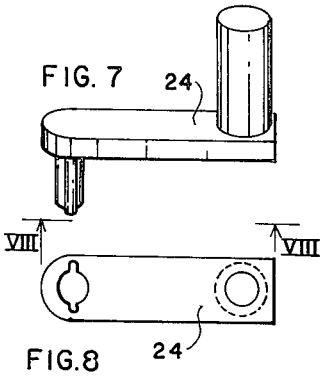
FIG. 7
FIG. 8
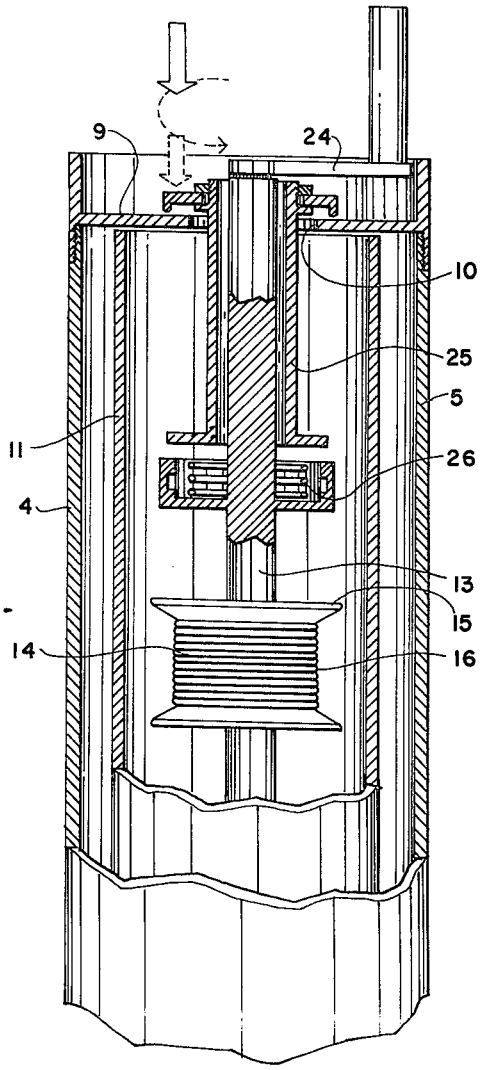
FIG. 6

ROLLAWAY FENCE

BACKGROUND OF THE INVENTION

The present invention relates to a rollaway fence. More particularly, the invention relates to a rollaway fence having a plurality of fence posts supported in upright positions in spaced substantially parallel relation to each other.

Objects of the invention are to provide a rollaway fence of simple structure, which is inexpensive in manufacture, occupies a very small space when not utilized, and functions efficiently, effectively and reliably as a fence along any desired perimeters to provide any desired pattern of fencing, indoors or outdoors.

BRIEF DESCRIPTION OF THE DRAWINGS:

In order that the invention may be readily carried into effect, it will now be described with reference to the accompanying drawings, wherein:

FIG. 5 is an exploded perspective view, on an enlarged scale, partly cut away and partly in section, of an embodiment of the rollaway fence of the invention;

FIG. 6 is a view, on an enlarged scale, partly cut away and partly in section, of the embodiment of FIG. 5 in assembled condition;

FIG. 7 is a perspective view, on an enlarged scale, of an embodiment of the handle device of the rollaway fence of the invention; and FIG. 8 is a view, taken along the lines VIII—VIII, of FIG. 7.

DETAILED DESCRIPTION OF THE INVENTION

Figure 1:
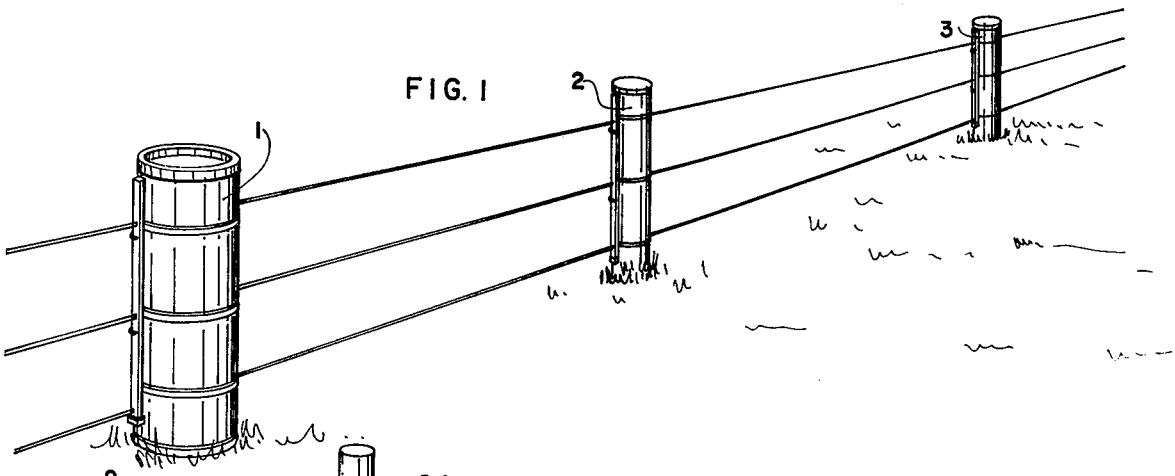
FIG. 1 is a perspective view of an embodiment of the rollaway fence of the invention in extended linear position.

The rollaway fence of the invention has a plurality of fence posts 1, 2, 3, and so on (FIG. 1) supported in upright positions in spaced substantially parallel relation to each other. Each of the fence posts 1 to 3, and so on, constitutes a fence in itself and is identical to the other fence posts. Thus, a single fence post 1 is described herein.

The rollaway fence of the invention comprises a housing 4 (FIGS. 2, 3, 5 and 6) of substantially elongated cylindrical configuration having a substantially cylindrical side 5, a plurality of spaced side holes 6, 7 and 8 (FIG. 2) formed through said side and extending along a lateral line thereof, a top base 9 (FIGS. 2 to 6) and a top hole 10 formed coaxially through said top base (FIGS. 5 and 6).

A split cylindrical guide member 11 (FIGS. 3, 5 and 6) is coaxially positioned in the housing 4 in spaced relation with said housing. The guide member 11 has a laterally extending gap 12 (FIG. 3) formed therethrough.

A shaft 13 is coaxially rotatably mounted in the guide member 11 in spaced relation with said guide member and extends through the top hole 10 of the housing (FIGS. 5 and 6).

Figure 2:
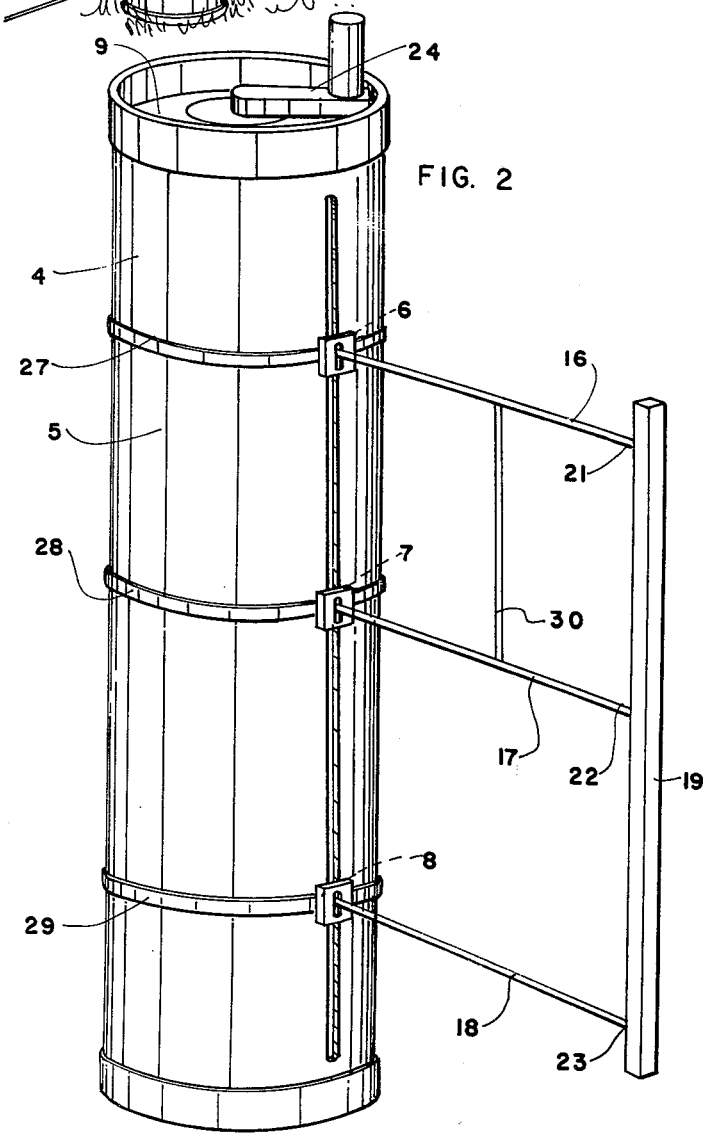
FIG. 2 is a perspective view, on an enlarged scale, of an embodiment of the rollaway fence of the invention.
Figure 3:
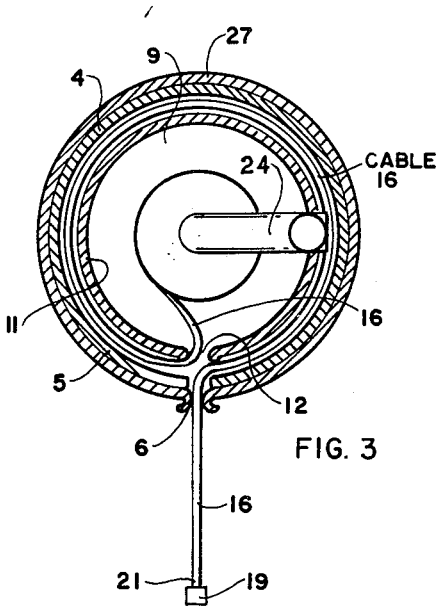
FIG. 3 is an axial view, on an enlarged scale, partly in section, of the embodiment of FIG. 2.
Figure 4:
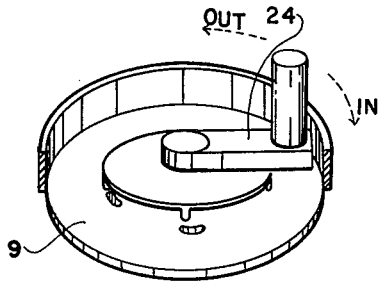
FIG. 4 is a partly cut away view, on an enlarged scale, of the top part of the embodiment of FIG. 2.

A plurality of rolls of flexible fence cable are wound on the shaft in spaced parallel relation. Although three rolls of flexible fence cable are wound on the shaft 13 on individual reels or spools in the illustrated embodiment of the example, only a single roll 14 of flexible fence cable is illustrated as being wound on said shaft, as shown in FIGS. 5 and 6, on a spool or reel 15. The roll 14 of flexible fence cable is coaxially positioned in a diametrical plane including the side hole 6 and the remaning two rolls of flexible cable, which are not shown in the Figures, are coaxially positioned in diametrical planes including the side holes 7 and 8, respectively (FIG. 2). The cable of each of the rolls of flexible fence cable passes through the gap 12 of the guide member 11. This is illustrated for the cable 16 of the illustrated roll 14 of flexible fence cable in FIG. 3. The cables of the rolls of flexible fence cable, after passing through the gap 12 of the guide member 11, pass around said guide member, as shown in FIG. 3 and each of said cables passes through a corresponding one of the side holes 6, 7 and 8 of the housing 4, as shown in FIG. 2, wherein the cables 17 and 18 of the remaning two rolls of flexible fence cable, not shown in the Figures, are shown extending through the side holes 7 and 8, respectively.

A cross bar 19 (FIGS. 2 and 3) is positioned outside the housing 4 parallel to the axis 20 (FIG. 5) of said housing. The free ends 21, 22 and 23 of the cables 16, 17 and 18, respectively (FIG. 2), are affixed to the cross bar 19 in spaced parallel relation with each other. The cross bar 19 is releasably affixable to the next-adjacent fence post.

A handle device 24 (FIGS. 2 to 4 and 6 to 8) is positioned outside the housing 4 and affixed to the shaft 13 at the top hole 10 of said housing for manually rotating said shaft to selectively release and retract the cables 16, 17 and 18. Thus, the user need merely release the cables 16 to 18 from the fence post and extend them to the next-adjacent fence post to which he may then secure the cross bar 19. If that section of fence is to be opened, the user need merely retract the cables via the handle 24 thereby housing said cables in the fence post.

A locking device 25 of any suitable type, including a spring 26, is provided in the housing 4 for locking the cables 16 to 18 at any selected distance of the cross bar 19 from the fence post in accordance with the position of the handle device 24. The locking device 25 is normally biased by its spring 26 in an upward direction, opposite to the arrows shown in FIG. 6. The locking device 25 is then disengaged and the shaft 13 is freely rotated via the handle device 24, as shown in FIGS. 5 and 6. When a sleeve, loosely surrounding the shaft 13, is manually forced downward, in the direction of the arrows shown in FIG. 6, against the action of the spring 26 and the sleeve is rotated a few degrees counterclockwise, the lock is engaged. This is due to the fact that radially extending lock projections extending from the bottom of the sleeve then lock into corresponding lock slots in an annular collar coaxially affixed to the shaft 13, and laterally extending projections extending from a collar coaxialy affixed to the top of the sleeve simultaneously extend into slots formed through the top base 9 of the housing 4. The shaft 13 and the handle device 24 are then locked in position and cannot rotate. The locking device 25 is disengaged, as desired, by rotating the top collar of the sleeve a few degrees clockwise. This frees the bottom projections of the sleeve from the lock slots of the collar of the shaft 13 and permits the spring 26 to move said shaft upward whence it is freely rotatable.

In order to strengthen the peripheral structure of the fence post, a plurality of circular bands or braces 27, 28 and 29 are provided around the housing 4. The bands 27, 28 and 29 are provided in the diametrical planes of the side holes 6, 7 and 8, respectively.

Spacing members such as, for example, a spacing member 30, as shown in FIG. 2, may be connected at various intervals between the cables 16 and 17 and between the cables 17 and 18, in order to maintain said cables in generally parallel relation with each other.

While the invention has been described by means of a specific example and in a specific embodiment, I do not wish to be limited thereto, for obvious modifications will occur to those skilled in the art without departing from the spirit and scope of the invention.

I claim:

1. A rollaway fence having a plurality of fence posts supported in upright positions in spaced substantially parallel relation to each other, each of said fence posts of said rollaway fence comprising a housing of substantially elongated cylindrical configuration having a side, a plurality of spaced side holes formed through the side and extending along an imaginary lateral line thereof, a top base and a top hole formed through the top base;

a split cylindrical guide member coaxially positioned in the housing in spaced relation with said housing, said guide member having a laterally extending gap forming a split therethrough;

a shaft coaxially rotatably mounted in the guide member in spaced relation with said guide member and extending through the top hole of the housing;

a plurality of reels coaxially affixed to the shaft and mutually spaced along said shaft;

a plurality of rolls of flexible fence cable each woundon a corresponding one of the reels in spaced parallel relation with the cable of each of said rolls passing through the gap of the guide member, around said guide member and through a corresponding one of the side holes of the housing;

a cross bar outside the housing positioned parallel to the axis of said housing, the free end of each of the cables being affixed to the cross bar in spaced parallel relation with the other cables and said cross bar being releasably affixable to the next-adjacent fence post; and handle means positioned outside the housing and affixed to the shaft at the top hole of said housing for manually rotating said shaft to selectively release and retract said cables.

2. A rollaway fence, as claimed in claim 1, further comprising locking means in the housing for locking the cables at any selected distance of the cross bar from the fence post in accordance with the position of the handle means.

* * * * *